United States Patent [19]

Murata

[11] 4,129,763

[45] Dec. 12, 1978

[54] PUSH BUTTON SWITCH ASSEMBLY

[75] Inventor: Taneo Murata, Tokyo, Japan

[73] Assignee: Alps Electric Co., Ltd., Japan

[21] Appl. No.: 766,802

[22] Filed: Feb. 8, 1977

[51] Int. Cl.[2] ..... H01H 3/12

[52] U.S. Cl. ..... 200/159 A; 200/159 R; 200/5 A; 200/156

[58] Field of Search ..... 200/5 A, 159 R, 159 A, 200/159 B, 340, 156 A

[56] References Cited

U.S. PATENT DOCUMENTS

| | | | |
|---|---|---|---|
| 3,888,807 | 6/1975 | Lockard | 200/159 R |
| 3,996,429 | 12/1976 | Chu | 200/159 A |

*Primary Examiner*—Ro E. Hart

*Attorney, Agent, or Firm*—Guy W. Shoup; Gerard F. Dunne

[57] ABSTRACT

A pushbutton switch is described which comprises a movable contact member having a snap-action disc portion bowing at its center away from said base plate and provided at its center with a movable contact and at its periphery with one or more movable contacts, and a base plate having fixed contacts located in the positions corresponding to the movable contacts. When the pushbutton is depressed to push the movable contact member toward the base plate, the movable contacts located at the periphery first come into contact with the respective fixed contacts and then the disc portion snaps or turns over toward the base plate so as to bring the movable contact located at the center into contact with the fixed contact on the base plate.

2 Claims, 3 Drawing Figures

PUSH BUTTON SWITCH ASSEMBLY

BACKGROUND OF THE INVENTION

The invention relates to an improved pushbutton switch for use in a table electronic calculator or the like.

SUMMARY OF THE INVENTION

It is an object of the present invention to provide an improved pushbutton switch having a superior electrical characteristic.

Another object of the present invention is to provide an improved pushbutton switch performing a stabilized switching operation without vibrations.

Still another object of the present invention is to provide an improved pushbutton switch which is effective to prevent its contacts from chattering.

A further object of the present invention is to provide an improved pushbutton switch which is simple in structure and easy to construct a key board switch of a desired number of keys.

In accordance with the present invention, there is provided a pushbutton switch comprising a base plate having fixed contacts thereon, a frame having its opposite ends opened and mounted on the base plate, a movable contact member attached to the frame and having movable contacts thereon, an insulating plate attached to the frame and having a projection abutting on the movable contact member to urge the same upwardly out of contact from the base plate, and a pushbutton supported for reciprocating movement in the frame to push the movable contact member toward the base plate so as to bring the movable contacts into contact with the respective fixed contact. The movable contact member is formed integrally with an attachment portion attached to the frame, a snap-action disc portion bowing at its center away from the base plate and provided at its center with a contact and at its peripheral points with one or more contacts, and a connection portion connecting the attachment portion and the disc portion. The base plate having fixed contacts located in the positions corresponding to the respective movable contacts on the disc portion. When the switch is depressed to push the movable contact member toward the base plate, the movable contacts located at the peripheral points first come into contact with the respective fixed contacts and then the disc portion of the movable contact member is snapped or turned over toward the base plate so as to bring the movable contact located at its center into contact with the fixed contact on the base plate.

BRIEF DESCRIPTION OF THE DRAWINGS

The invention will be more fully understood and its objects and advantages further appreciated by referring now to the following detailed description taken in conjunction with the drawings, in which.

DESCRIPTION OF THE PREFERRED EMBODIMENT

Figure 1:
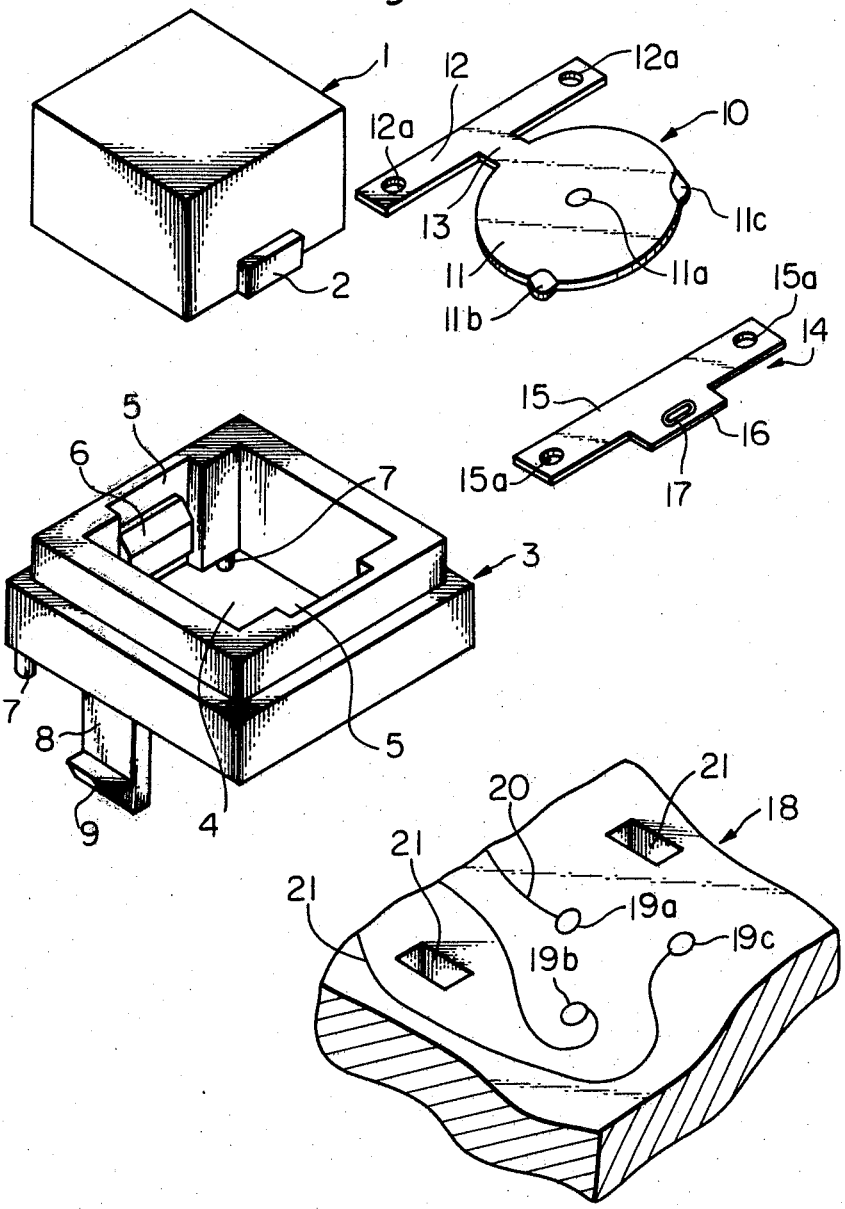
FIG. 1 is an exploded perspective view of the pushbutton switch of the present invention.

Referring now to FIG. 1, there is illustrated a pushbutton switch in an exploded fashion. The pushbutton switch comprises a generally square-shaped pushbutton 1 which may be formed of a synthetic resin. The pushbutton 1 has stopper portions 2 and 2 extending outwardly from the lower portions of its opposite side walls. A switch frame 3, which may be formed of a synthetic resin, is formed to have a square-shaped opening 4 provided with opposite grooves 5 and 5 so that the pushbutton 1 can slide along the inner walls of the switch frame 3 with the stopper portions 2 and 2 engaging the grooves 5 and 5. Provided in the grooves 5 and 5 are tab portions 6 and 6 each having its one end coupled to the inner wall of the groove 5 so that its free end can engage the stopper portions 2 and 2. Projections 7 and 7 are provided to extend from the opposite ends of one side of the switch frame 3 for fixing a movable contact member 10 and an insulating plate 14 which will be described later. A pair of resilient legs 8 and 8 are also provided to extend from the bottom of the switch frame, each of which has its tip end formed with a nail 9 for fixing the switch frame 3 to a base plate 18.

Figure 2:
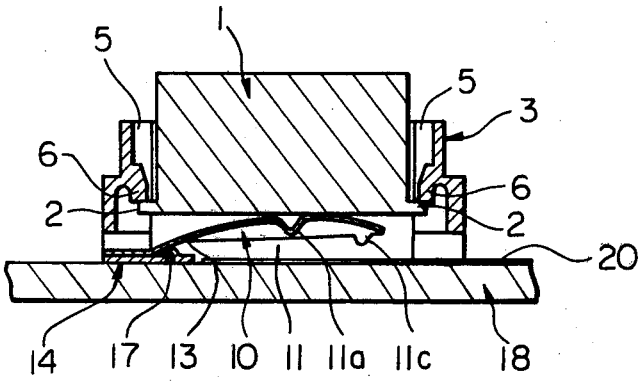
FIG. 2 is a sectional view of the pushbutton switch of FIG. 1.
Figure 3:
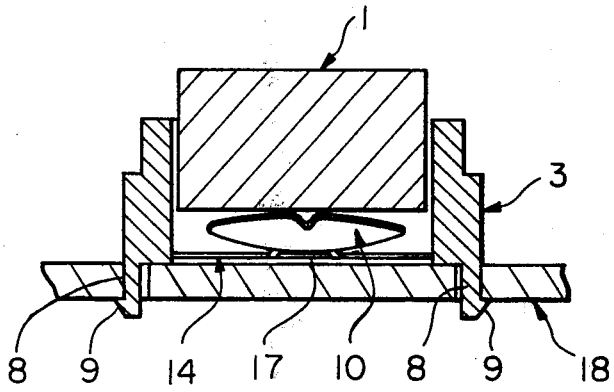
FIG. 3 is a sectional view of the pushbutton switch with the switch turned an angle of 90 from the position shown in FIG. 2.

The reference numeral 10 indicates a movable contact member formed of a resilient and conductive metal plate such as a stainless steel plate. The movable contact member is formed integrally with a disc portion 11 performed to slightly bow at its center upwardly as illustrated in FIG. 2, a generally rectangular-shaped attachment portion 12 provided with holes **12*a* and 12*a* for insertion of the projections 7 and 7 of the switch frame 3 thereinto, and a connection portion 13 connecting the disc portion 11 and the attachment portion 12. The disc portion 11 is shown having a contact 11*a* at its center and contacts 11*b* and 11*c* at its peripheral points spaced circumferentially so that the contacts 11*b* and 11*c* and the connection portion 13** divide the circumference of the disc portion substantially into three equal lengths.

The reference numeral 14 indicates an insulating plate formed of a synthetic resin film. The insulating plate 14 is formed with holes **15*a* and 15*a* in positions corresponding to the holes 12*a* and 12*a* and is interposed between the attachment portion 12 of the movable contact member 10 and the base plate 18. The insulating plate also has a projecting portion 16 formed with a projection 17 extending upwardly for pushing against the connection portion 13 so as to maintain the disc portion 11 out of contact from the base plate 18**.

The base plate 18 may be, for example, an etched and goldplated copper foil laminated plate and has fixed contacts **19*a*, 19*b* and 19*c* thereon, which are located in positions corresponding to the respective movable contacts 11*a*, 11*b* and 11*c* on the disc portion 11 of the movable contact member 10. Also provided on the surface of the base plate 19 are lines 20 connecting the fixed contacts to respective terminals, not shown. The reference numerals 21 and 21 indicates openings into which the attachment legs 8 and 8 are inserted for attachment of the frame 3 to the base frame 19**.

The fabrication of the pushbutton switch will be described. After the projections 7 and 7 of the switch frame 3 are inserted into the holes **12*a* and 12*a* of the attachment portion 12 of the movable contact member 10 and then into the holes 15*a* and 15*a* of the insulating plate 15 so that the contacts 11*a*, 11*b* and 11*c* face the base plate 18 and the projection 17 of the insulating plate 14 abuts on the connection portion 13, the projections are caulked to fix the movable contact member 10 and the insulating plate 14 to the switch frame 3. Then, the pushbutton 1 is inserted into the opening 4 of the switch frame 3 with the projections 2 and 2 sliding along the grooves 5 and 5. As a result, the tab portions 6 and 6 are pushed inwardly and when the projections 2 and 2 pass the tab portions 6 and 6, the tab portions return to their initial positions, due to their resiliency into engagement with the upper face of the projections 2 and 2 so as to prevent the pushbutton 1 from drawing out. Thereafter, the nailed attachment legs 8 and 8 are inserted into the holes 21 and 21 of the base plate 18 under pressure so that the nails 9 and 9 engage the bottom of the base plate 18 to fix the frame 3 to the base plate 18**.

The operation of the pushbutton switch in accordance with the present invention will be described. When the switch is not depressed, the projection 17 of the insulating plate 14 pushes against the connection portion 13 of the movable contact member 10 so that the disc portion 11 is urged upwardly out of contact from the base plate 18 to push the pushbutton 1 upwardly until the projections 2 and 2 of the pushbutton 1 abut on the free ends of the tab portions 6 and 6. In this condition, the movable contacts **11*a*, 11*b* and 11*c* remain out of contact from the fixed contacts 19*a*, 19*b* and 19*c* on the base plate 18** and the switch is opened.

If the pushbutton 1 is depressed, the pushbutton 1 pushes the disc portion 11 so as to bring the movable contacts **11*b* and 11*c* into contact with the respective fixed contacts 19*b* and 19*c* on the base plate 18. Further pushing the pushbutton 1 causes the bowing disc portion 1 to snap or turn over toward the base plate 18 so as to bring the movable contact 11*a* centrally located on the disc portion 11 into contact with the fixed contact 19*a* on the base plate 18**, whereby the switch is closed.

When the pressure exerting on the pushbutton 1 is released, the switch is driven in the reverse order and the disc portion 11 pushes against the pushbutton 1 so that the switch is opened again.

The pushbutton switch of the present invention as thus described boasts several advantages as follows:

(1) The construction of the movable contact member, in which the disc portion provided with movable contacts is connected through the connection portion to the attachment portion, is effective to restrict vibrations resulting from the snap-action of the disc portión so as to minimize chattering action.

(2) Since the movable contacts come into contact with the respective fixed contacts in two steps, if the movable contact located centrally on the disc portion is used as a common contact, the common contact can contact with the other contacts securely and simultaneously, which provides a superior electrical characteristic.

(3) Easy to construct a multi-contact switch using a snap-action disc plate as its movable contact member.

(4) The snap-action provides a good touch to the operator.

(5) Simple in construction and easy to produce a keyboard switch having a desired number of keys associated with a base plate having the corresponding number of fixed contacts thereon.

The invention has been described in detail with reference to a preferred embodiment thereof, but it will be understood that variations and modifications can be effected within the spirit and scope of the invention. For example, the disc portion of the movable contact member may have its periphery provided with one or more contacts.

What is claimed is:

1. A pushbutton switch comprising:

a base plate;

a frame mounted on said base plate and having its opposite ends open;

a movable contact member formed integrally with an attachment portion attached to said frame, a snap-action disc portion bowing at its center away from said base plate and provided at its center with a contact and at its peripheral points with one or more contacts, and a connection portion connecting said attachment portion and said disc portion;

an insulating plate attached to said frame and underlying said connection portion, said insulating plate having a projection extending upwardly and abutting on said connection portion to urge said disc portion upwardly out of contact from said base plate;

said base plate having fixed contacts located in the positions corresponding to said respective movable contacts on said disc portion; and a pushbutton supported for reciprocating movement in said frame to push said movable contact member toward said base plate so that said movable contacts located at said peripheral points first come into contact with said respective fixed contacts and then said disc portion is snapped toward said base plate so as to bring said movable contact located centrally on said disc portion into contact with said fixed contact on said base plate.

2. A pushbutton switch as set forth in claim 1, wherein said disc portion has its peripheral points provided with two contacts so that said two contacts and said connection portion divide the circumference of said disc portion substantially into three equal lengths.

* * * * *